US005832913A

United States Patent [19]

Arends

[11] Patent Number: 5,832,913

[45] Date of Patent: Nov. 10, 1998

[54] TILE SAW ACCESSORY

[76] Inventor: William R. Arends, 5330 Goni Rd., Carson City, Nev. 89706

[21] Appl. No.: 749,663

[22] Filed: Nov. 15, 1996

Related U.S. Application Data

[63] Continuation-in-part of Ser. No. 452,858, May 30, 1995, abandoned.

[51] Int. Cl.[6] ..... B28D 1/04; B28D 7/04

[52] U.S. Cl. ..... 125/13.01; 33/474; 83/435.14; 83/435.15; 83/468.3; 83/581; 269/304; 451/438

[58] Field of Search ..... 83/437.1, 437.2, 83/435.11, 435.12, 435.14, 435.15, 435.27, 467.1, 468.3, 468.4, 581, 745, 953; 269/303, 304, 315, 319; 125/13.01, 35; 451/438; 33/465, 471, 474, 479, 480, 481, 526, 527

[56] References Cited

U.S. PATENT DOCUMENTS

| | | | |
|---|---|---|---|
| 1,299,367 | 4/1919 | McMichael | 83/435.14 |
| 2,881,812 | 4/1959 | Alumbaugh et al. | 83/435.15 |
| 2,998,813 | 9/1961 | Wilson | 83/435.14 X |
| 3,090,615 | 5/1963 | May | 125/35 X |
| 3,124,175 | 3/1964 | McCloud | 83/581 |
| 3,367,224 | 2/1968 | Thiel | 83/467 |
| 3,622,145 | 11/1971 | Gibson | 269/297 |
| 4,051,759 | 10/1977 | Oliff | 83/471.3 |
| 4,054,077 | 10/1977 | Gram | 83/745 |
| 4,111,409 | 9/1978 | Smith | 83/435.15 X |
| 4,155,165 | 5/1979 | Gillingwater | 33/104 |
| 4,218,947 | 8/1980 | Laviola | 83/762 |
| 4,441,394 | 4/1984 | Barsotti | 83/435.14 X |
| 4,693,156 | 9/1987 | Olvera | 83/435.14 X |
| 4,907,482 | 3/1990 | Hujo | 83/745 |
| 4,909,111 | 3/1990 | Noble | 83/397 |
| 4,924,843 | 5/1990 | Waren | 125/35 |
| 5,373,835 | 12/1994 | Pourtau | 225/96.5 X |
| 5,402,701 | 4/1995 | Ingram | 83/468.3 |
| 5,615,665 | 4/1997 | Thiriet | 225/96.5 X |

*Primary Examiner*—Eugenia Jones
*Attorney, Agent, or Firm*—David H. T. Wayment

[57] ABSTRACT

An accessory for a wet diamond tile saw that allows the saw operator to cut accurate and consistent angled cuts in both planar and non-planar tile and related materials such as stone. The accessory has a slot in the bottom which sits over the fence on the tile saw, thus holding the accessory at a fixed angle to the saw. The accessory can be fitted with a pivoting plate which can hold curved pieces of tile.

4 Claims, 7 Drawing Sheets

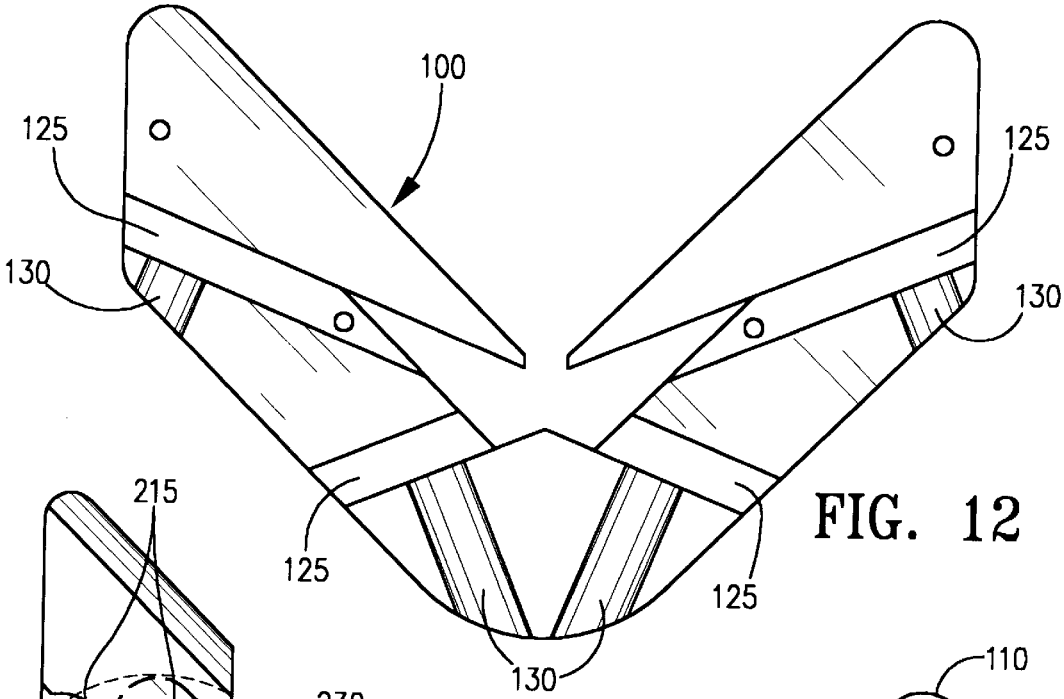
FIG. 12
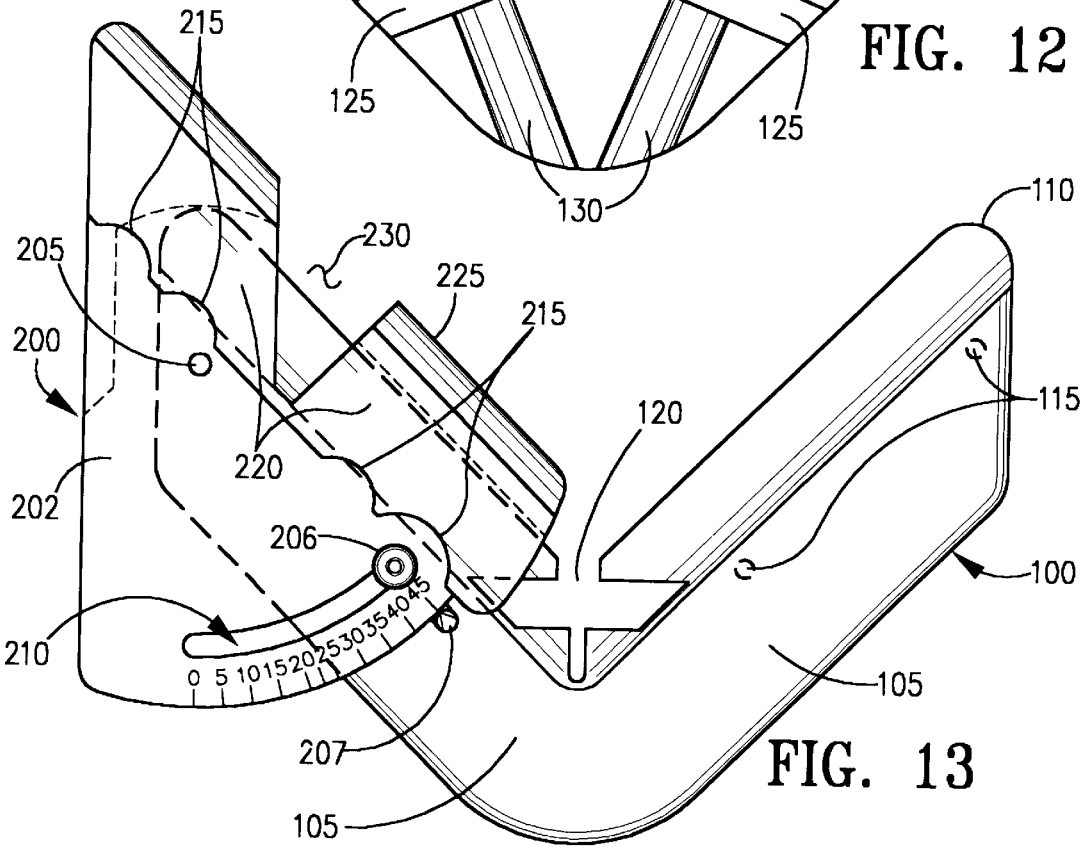
FIG. 13
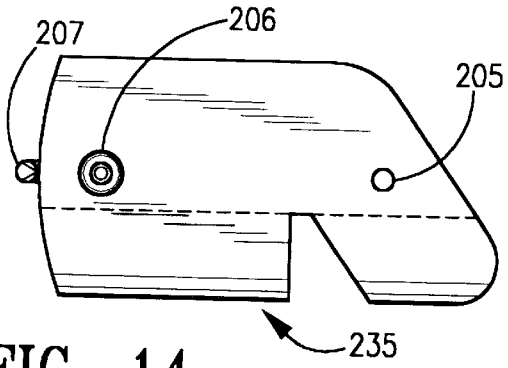
FIG. 14
FIG. 15
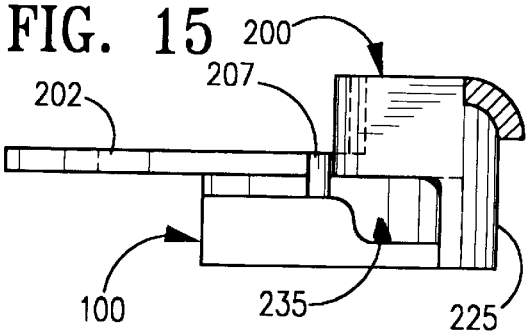

TILE SAW ACCESSORY

BACKGROUND OF THE INVENTION

1. Field of the Invention

This invention relates generally to tile cutting. Specifically, the invention is designed to be an accessory to a wet diamond tile cutting saw.

2. Cross References

This application is a continuation in part of application Ser. No. 08/452,858, filed May 30, 1995, entitled Accessory for Cutting Angles on a Tile Saw, now abandoned, which is incorporated herein by this reference.

3. Description of Related Art Including Information Disclosed Under 37 CFR 1.97 and 1.98

Ceramic tile and related materials, such as stone, are popular materials for covering surfaces such as floors, tub and shower enclosures, and counter tops, in residential and commercial establishments. While tile has a number of desirable features, it is difficult to cut. Normally tile is cut using a saw which has a water cooled diamond saw blade. These tile saws are well known in the prior art: in general, the saw, 300, consists of a reservoir, 305, for water, a sliding table, 310, with a fence, 315, for holding the tile, an electric motor which turns an arbor, 320, holding a diamond coated blade, 325, (where the blade is perpendicular to the fence), and a pump which pumps water from the reservoir over the turning blade.

The vast majority of tile is planar and square, and so by placing one edge of the tile against the fence on the sliding table of the tile saw, it is a simple matter to slide the table under the turning blade and make a cut in the tile at an angle of ninety degrees to the edge of the tile which is resting against the fence. Most of the time, a ninety degree cut is exactly what is wanted and so this arrangement works out quite well.

Sometimes, however, it is desirable to cut the tile at some angle other than ninety degrees. When one of these other angles is wanted in a tile, the tile saw operator normally makes use of an accessory (known colloquially as a "jig") which holds the tile at an angle to the fence of the tile saw. The prior art accessory is also well known and is discussed in the Description of Related Art section of patent application Ser. No. 08/452,858; the applicant incorporates that discussion by reference. Suffice it to say that there has been a long-felt need for an improved accessory for making angled cuts in tile. application Ser. No. 08/452,858 also discloses an accessory for making angled cuts in tile, and that disclosure is largely repeated in this application.

In addition to the problems encountered with the prior art in cutting planar, square pieces of tile (as discussed more fully in 08/452,858), the tile cutting industry has also experienced a long-felt need for an improved accessory for cutting curved tile. Curved tile is often used, for example, to cover the edge of a counter top. In cross-section, a piece of curved tile might have an "L" shape or be semi-circular. Curved tile presents special problems for the operator of a tile saw, especially when the operator wants to make an angled cut. Accordingly, there is a need for an accessory which has improved characteristics for making angled cuts, both in flat tile and in curved tile.

SUMMARY OF THE INVENTION

An accessory for wet diamond tile saws meeting the foregoing needs is disclosed. The accessory is a planar piece of material with two perpendicular arms and with a slot that fits over the fence on a tile saw and locks the accessory into a particular angle to the blade of the saw. Various embodiments of the invention are disclosed to allow the invention to work with different brands of tile saws, and to give the invention greater versatility. One embodiment of the invention has removable and adjustable leading edges, which extend the useful life of the invention and allow for the cutting of larger sizes of tile. The invention may be made with the slot at any angle, and may even include more than one slot. Examples of the invention with a single slot that allows for forty-five degree cuts, and with two slots allowing for twenty-two and one-half degree cuts, are shown.

A further embodiment of the invention shows the invention adapted with a pivoting plate which is shaped for holding curved tile. The pivoting plate can be fitted to one of the perpendicular arms. A piece of curved tile can then be placed over the leading edge of the plate and the plate can be pivoted to any angle between zero and forty-five degrees.

The invention can be made from a variety of materials such as hard plastic, polymer, graphite, or a metal such as aluminum. The material used to make the invention can either be solid or have cavities to reduce the weight of the invention and the amount of material needed for manufacture of the invention.

It is an object of the invention to give tile saw operators a simple accessory for making accurate and consistent angled cuts in tile and related materials.

It is a further object of the invention to provide an accessory for cutting tiles that greatly reduces the possibility of human error.

It is a further object of the invention to provide an accessory for cutting tiles that greatly reduces the need for operator pressure on the tile.

It is a further object of the invention to provide an accessory for cutting tiles that cannot slip out of adjustment.

It is a further object of the invention to provide an accessory for cutting tiles that mitigates the effect of a particular tile having an irregular edge.

It is a further object of the invention to provide an accessory for cutting tiles that greatly improves the ease and accuracy of cutting curved pieces of tile.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the claims.

BRIEF DESCRIPTION OF THE DRAWINGS

FIG. 12 is a bottom plan view of the invention showing the embodiment with two slots.

FIG. 13 is a top plan view of the invention showing a pivoting plate that attaches to one arm of the invention thus allowing for easy cutting of curved tile.

FIG. 14 is a top plan view of an adapter plate which interfaces with the pivoting plate.

FIG. 15 is a cross-sectional view of the invention demonstrating the attachment of the pivoting plate, and further demonstrating the placement of a piece of curved tile (which is not part of the invention and is shown as part of the environment) on the pivoting plate.

DESCRIPTION OF THE PREFERRED EMBODIMENT

Referring to FIGS. 1 through 12, we can see various embodiments of the invention, referred to as a Boomerangle®, 100, as it would be used to cut planar pieces of tile. The Boomerangle, 100, is formed with two perpendicular arms, 105, which lie in a single plane. This arrangement of the arms leaves a rectilinear opening between the arms which is suitable for receiving a square piece of planar tile. It should be noted that, in referring to tile, the applicant intends to refer both to ceramic and other man-made tile, as well as tile made from stone and other natural materials. The arms, 105, taper down to thin leading edges, 110. The arms, 105, and thin leading edges, 110, are the planar tile holding means. There is an opening, 120, at the junction of the leading edges, 110, and this opening, 120, is of sufficient size to allow the blade of a tile saw to pass between the leading edges, 110. The arms, 105, also have smooth holes, 115, which permit the attachment of optional accessories to the Boomerangle, 100.

There is a slot, 125, in the bottom of the Boomerangle, 100, and this slot, 125, is the means for engaging the fence of a tile saw. The slot, 125, is slightly larger than the fence of a tile saw, and is shaped so that, in cross section, it is the mirror image of the fence, so that the slot, 125, can engage the fence of a tile saw and make a tight fit. On the bottom of the Boomerangle, 100, there are protrusions, 130, which go from the back of the Boomerangle, 100, to the slot, 125. The protrusions, 130, have threaded holes, 135, which receive standard thumb screws, 140. The thumb screws, 140, are turned through the threaded holes, 130, until the thumb screws, 140, come into contact with the tile saw fence which is inside the slot, 125. In this way any movement of the Boomerangle, 100, along the length of the fence can be prevented.

Figure 1:
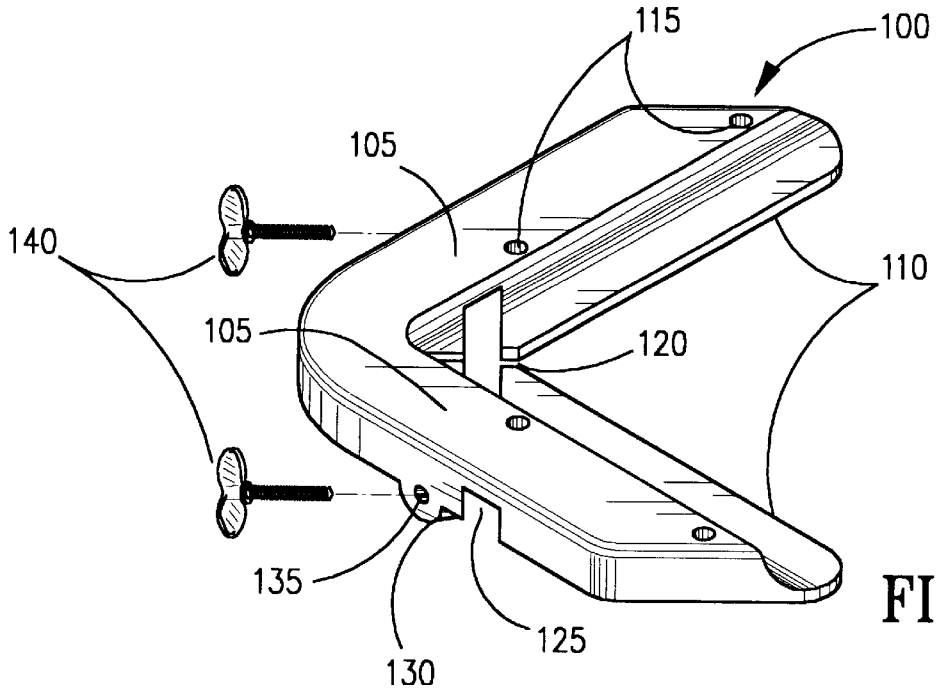
FIG. 1 is a perspective view of the invention.
Figure 2:
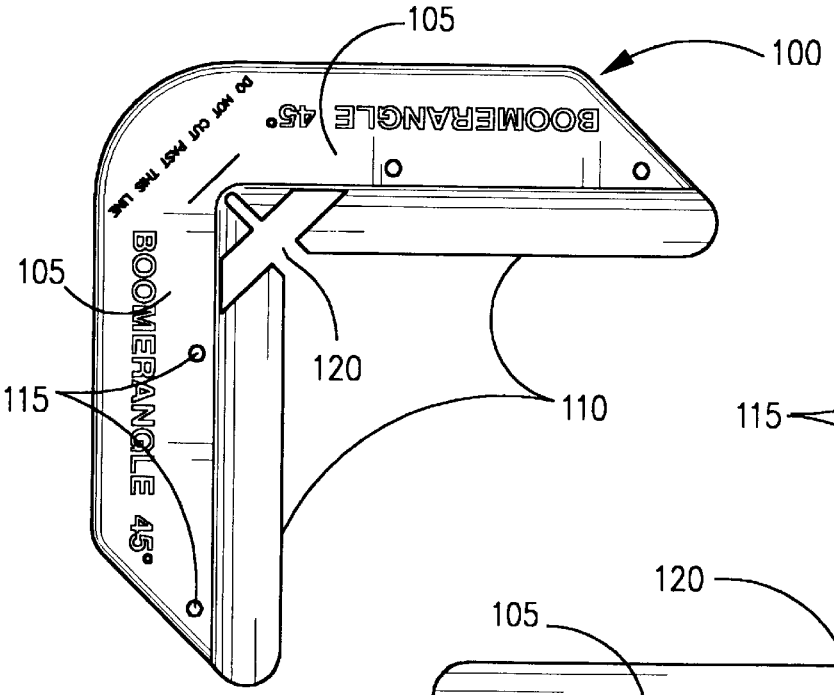
FIG. 2 is a top plan view of the invention.
Figure 3:
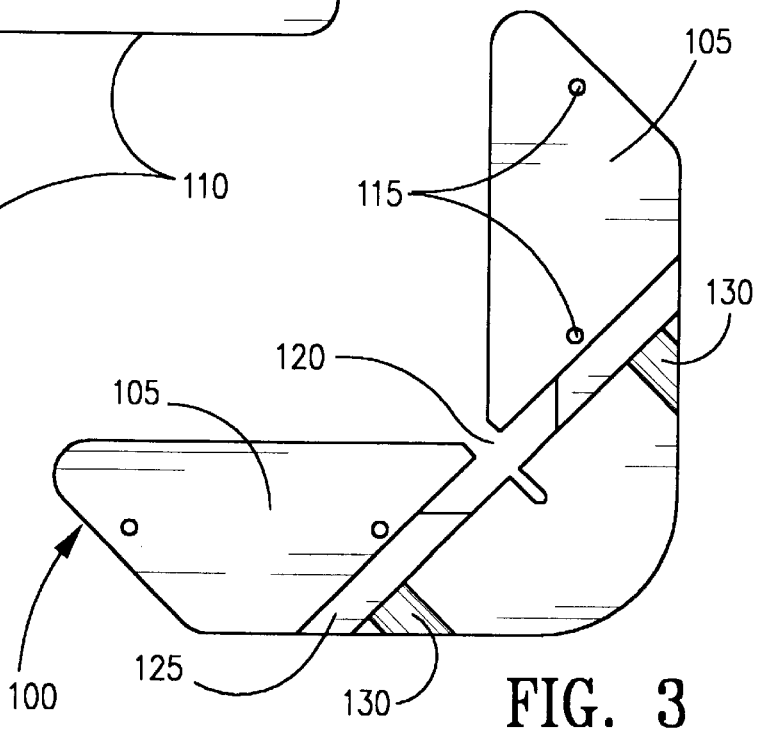
FIG. 3 is a bottom plan view of the invention.
Figure 4:
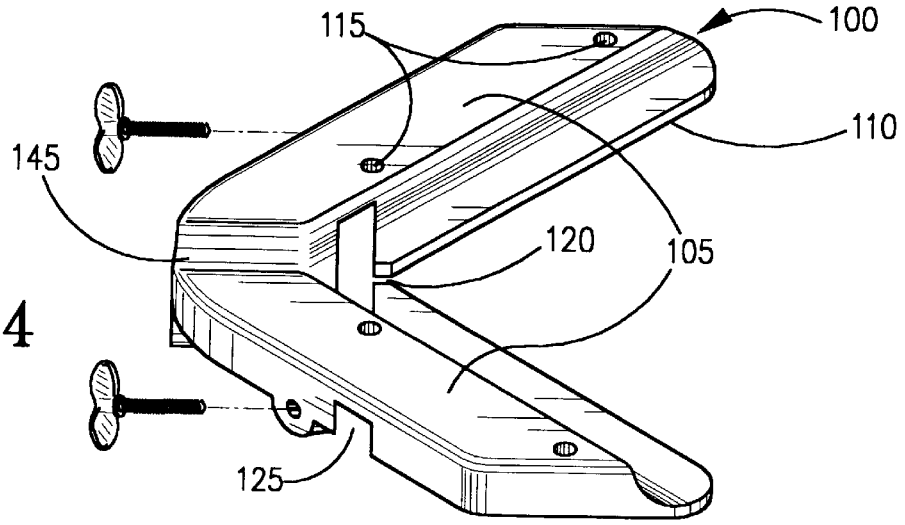
FIG. 4 is a perspective view of the invention showing a small variation in the body of the invention that allows the invention to make a better fit with certain brands of tile saws.
Figure 5:
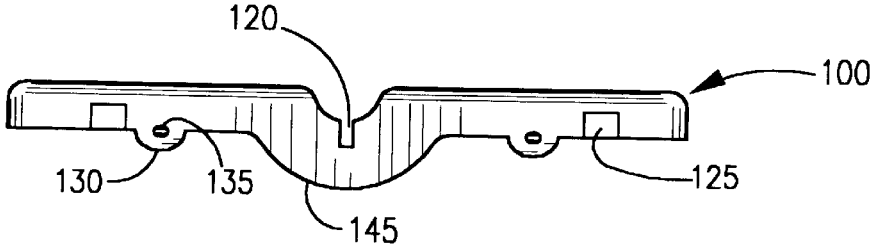
FIG. 5 is a front elevation view of the invention, showing the variation in body style.
Figure 6:
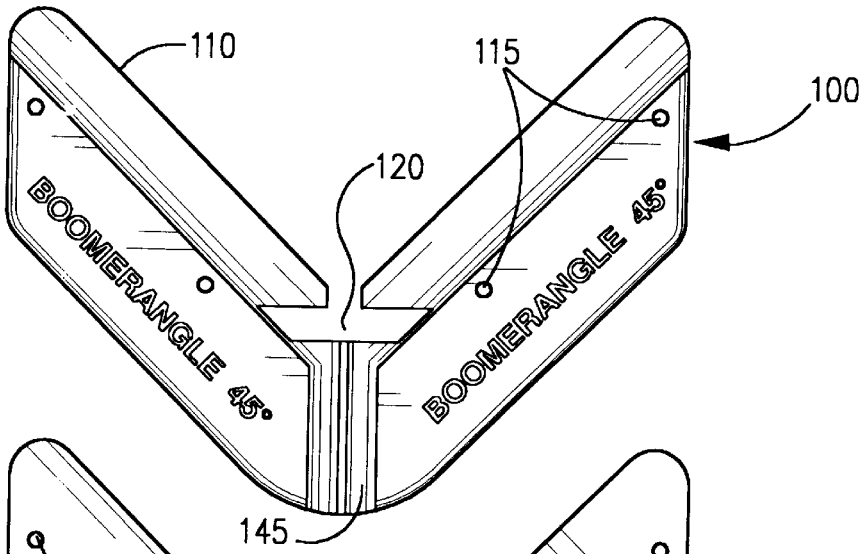
FIG. 6 is a top plan view of the invention showing the variation in body style.
Figure 7:
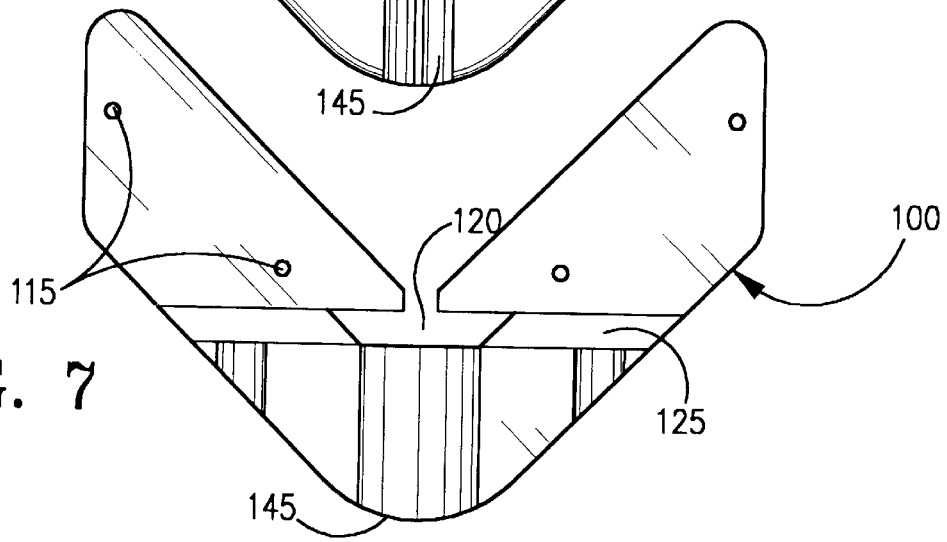
FIG. 7 is a bottom plan view of the invention showing the variation in body style.
Figure 8:
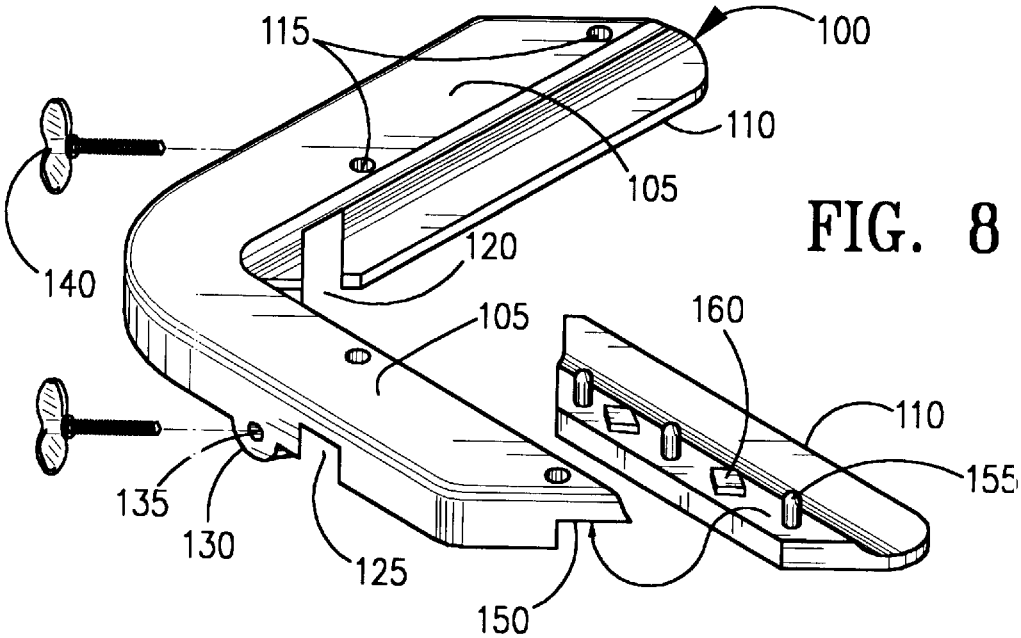
FIG. 8 is a perspective view of the invention showing an embodiment of the invention with detachable and adjustable leading edges.
Figure 9:
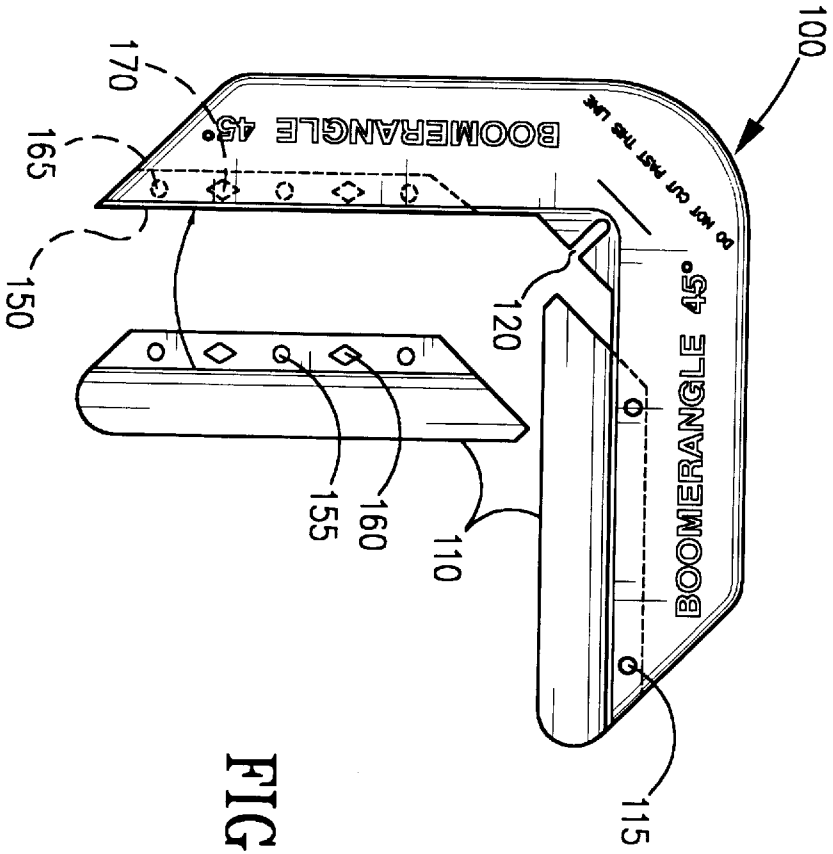
FIG. 9 is a top see-through view of the invention demonstrating one method for attaching the leading edges.
Figure 10:
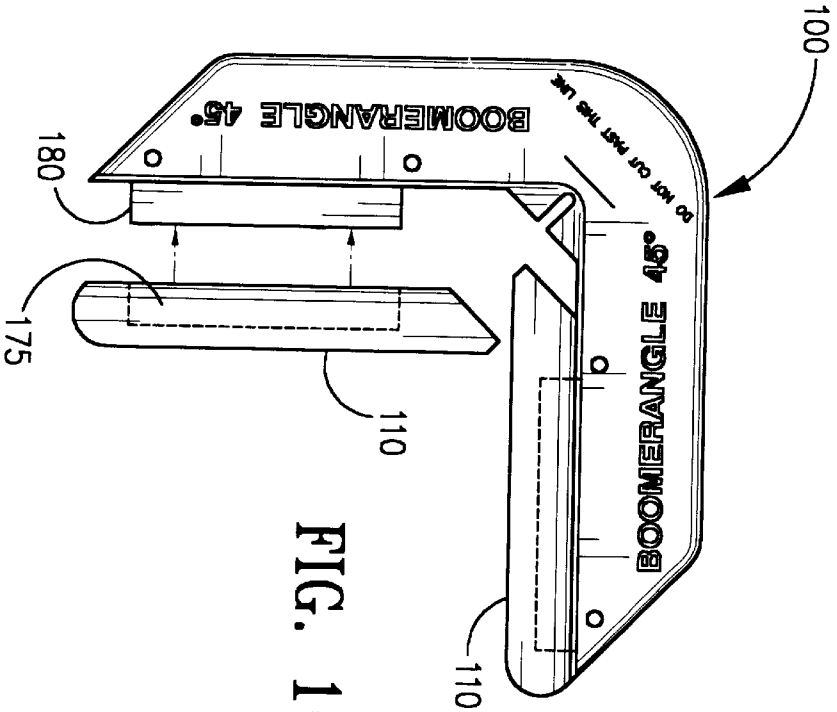
FIG. 10 is a top see-through view of the invention showing the alternative method for attaching the edges.

Looking at FIGS. 4 through 7, we can see an embodiment of the Boomerangle, 100, with a depression, 145, which allows the Boomerangle, 100, to make a better fit with certain brands of tile saws. FIGS. 8 and 9 illustrate an embodiment of the Boomerangle, 100, with the leading edges, 110, being part of a removable portion of the Boomerangle, 100. In this embodiment, the leading edges, 110, can be replaced when they become worn. The leading edges, 110, can also be extended outward (toward the terminal ends of the arms, 105). This extension is possible because the removable portion of the Boomerangle, 100, if fitted with pins, 155, and diamonds, 160, which fit into pin holes, 165, and diamond holes, 170, in the Boomerangle, 100. Accordingly, the removable portions can be extended toward the terminal ends of the arms, 105, by mounting the pins, 155, and diamonds, 160, which are near the junction end of the leading edges, 110, into the pin holes, 165, and diamond holes, 170, which are near the terminal ends of the arms, 105 (where it is understood that the terminal end of each arm, 105, is the end opposite of the junction of the arms, 105). Other shapes, besides pins, 155, and diamonds, 160, could, of course, be used to accomplish the same purpose. Pins, 155, and diamonds, 160, are used merely to illustrate two possible shapes. FIG. 10 illustrates an alternative method for replacing worn leading edges, 110, by having the leading edges, 110, be part of removable portions which can be attached with a mortise, 175, and tenon, 180, arrangement.

Figure 11:
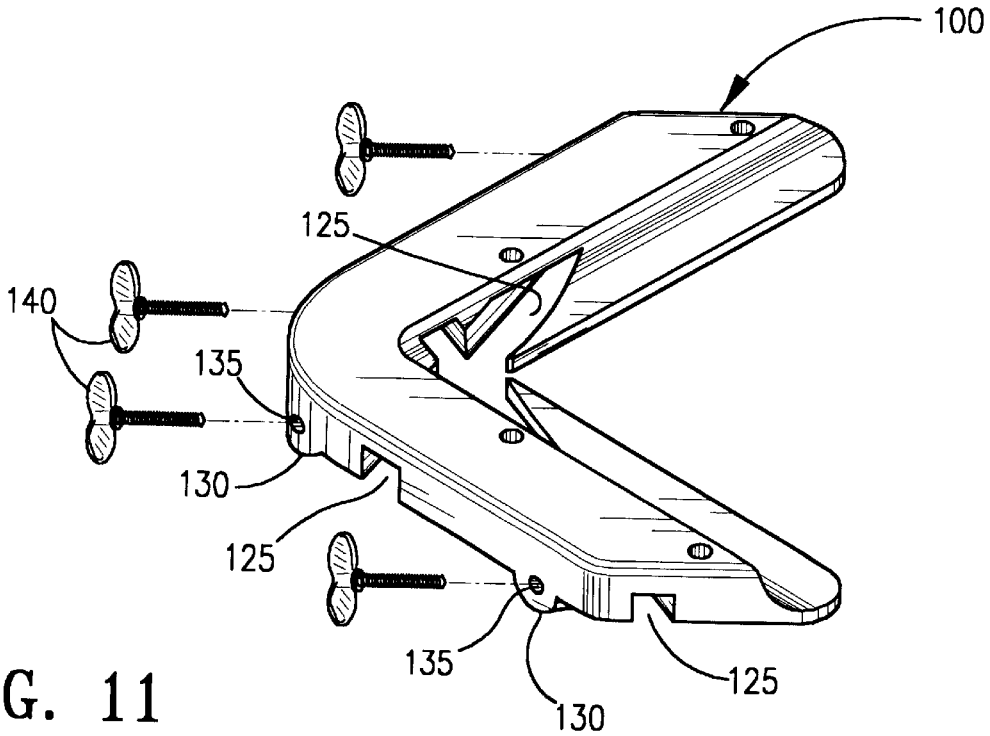
FIG. 11 is a perspective view of the invention showing two slots for cutting tiles at twenty-two and one-half degrees.
Figure 16:
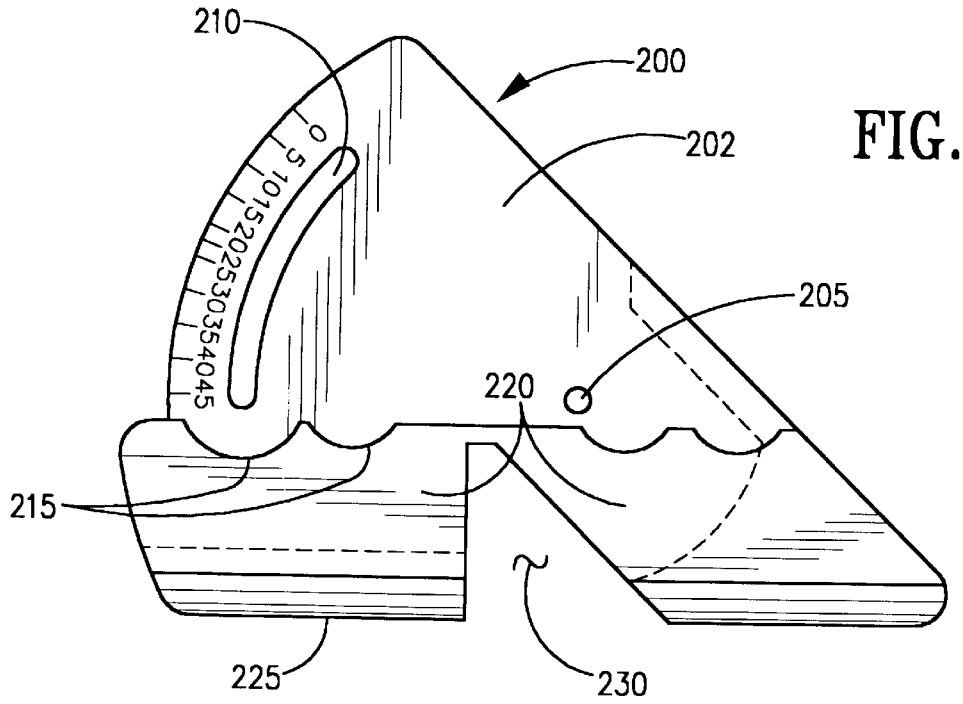
FIG. 16 is a top plan view of the pivoting plate portion of the invention.

FIGS. 11 and 12 show yet another embodiment of the Boomerangle, 100. In this embodiment, the Boomerangle, 100, is fitted with two slots, 125, which allow the tile to be cut at an angle of twenty-two and one-half degrees rather than the forty-five degree cut achieved with one slot, 125.

In FIG. 13 we see the Boomerangle, 100, fitted with a pivoting plate, 200, which is used for cutting non-planar pieces of tile. For the sake of making the drawing easier to understand, FIG. 13 shows a pivoting plate, 200, on only one arm, 105, of the Boomerangle, 100. In actual practice, however, a tile saw operator using the Boomerangle, 100, to cut non-planar tile will often find it more convenient to fit both arms, 105, of the Boomerangle, 100, with a pivoting plate, 200. The pivoting plate, 200, may be constructed of any of the materials mentioned above to construct the Boomerangle, 100.

Referring to FIGS. 13 through 17, we see that the pivoting plate, 200, has a back, planar section, 202, a pivot pin, 205, and a radial slit, 210. There is also a curved tile holding means section, 220, with thumb contours, 215, a curved front section, 225, and an angled opening, 230. The angled opening, 230, is placed in the front section, 225, and curved tile holding means section, 220, over the entire range where a tile saw blade could intersect the front section, 225, or the curved tile holding means section, 220, and this allows the blade of a tile saw to cut a piece of curved tile without damage to the pivoting plate, 200. FIG. 15 shows a piece of curved tile in order to demonstrate the environment of the invention.

FIGS. 14 and 15 show the adapter plate, 235. In cross section, the adapter plate, 235, is simply the mirror image of one arm, 105, of the Boomerangle, 100. The adapter plate, 235, provides a flat surface over which the top of the pivoting plate, 200, can pivot (where the "top" refers, collectively, to the planar section, 202, the tile holding means section, and the front section 205). The top of the pivoting plate, 200, is attached to the base section, 235, by means of a pivot pin, 205. The entire top of the pivoting plate, 200, can thus pivot over the adapter plate, 235.

Figure 17:
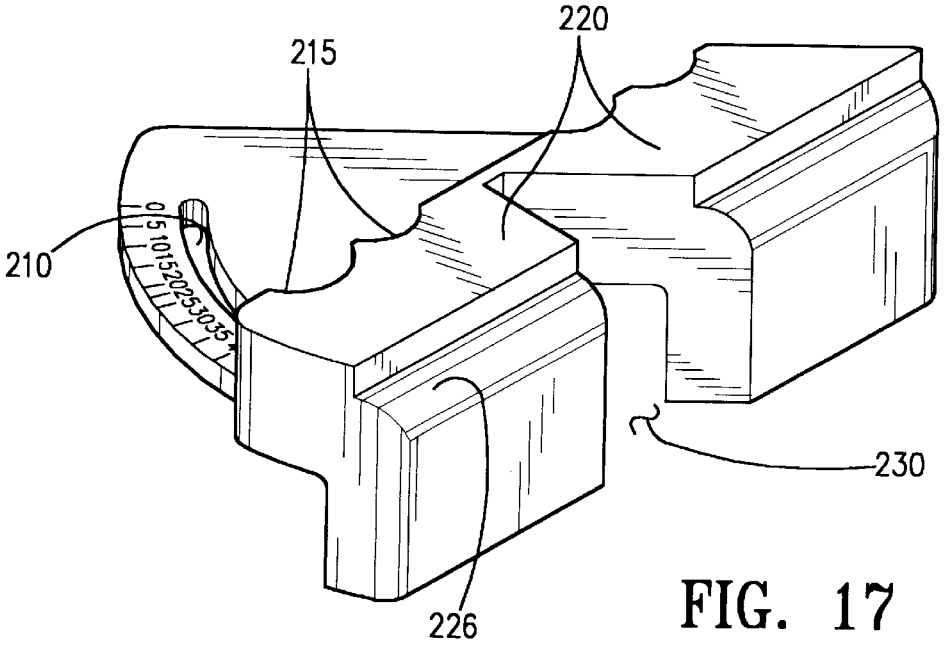
FIG. 17 is a perspective view of the pivoting plate.

Referring to FIGS. 13 through 15, we can see a threaded knob, 206, which would typically be inserted through the radial slit, 210, into a hole in the adapter plate, 235, so that the top of the pivoting plate, 200, could be locked into a particular angular orientation in relation to the adapter plate, 235. A pointer, 207, is fitted to the adapter plate, 235, and is oriented so as to point to the angles marked on the planar section, 202. Although not shown in the drawings, the adapter plate, 235, would typically be fitted with pins which would fit into the holes, 115, in the arms, 105, of the Boomerangle, 100. Referring to FIG. 17, we can see an optional indented portion, 226, which improves the performance of the pivoting plate, 200, with semi-circular pieces of curved tile.

Figure 18:
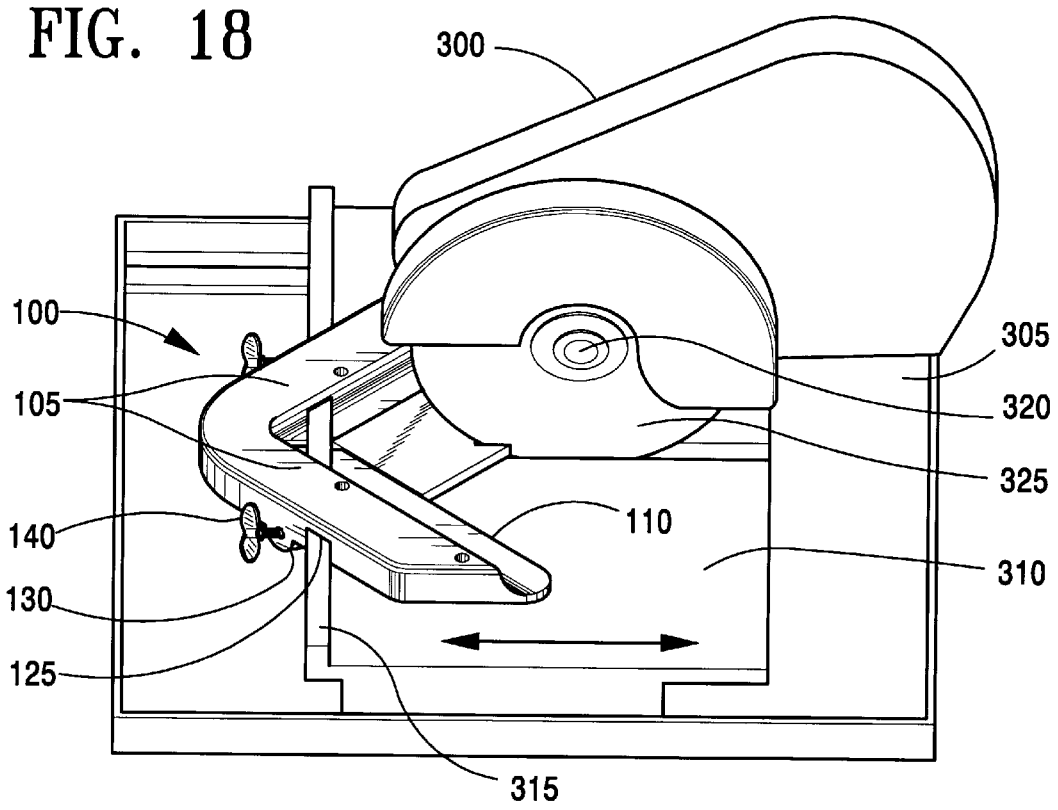
FIG. 18 is a perspective view of the invention being used to cut a planar piece of tile on a tile saw. The tile and the tile saw illustrate the environment of the invention.

Referring to FIG. 18, we see the Boomerangle, 100, being used with a tile saw. A planar piece of tile is sitting in the rectilinear opening between the arms, 105. The slot, 125, is fitted over the tile saw fence, and the thumb screws, 140, are preventing any movement of the Boomerangle, 100, along the length of the fence. As the tile saw operator slides the sliding table of the tile saw under the spinning blade, the blade pushes the tile into the edges, 110, of the arms, 105.

Figure 19:
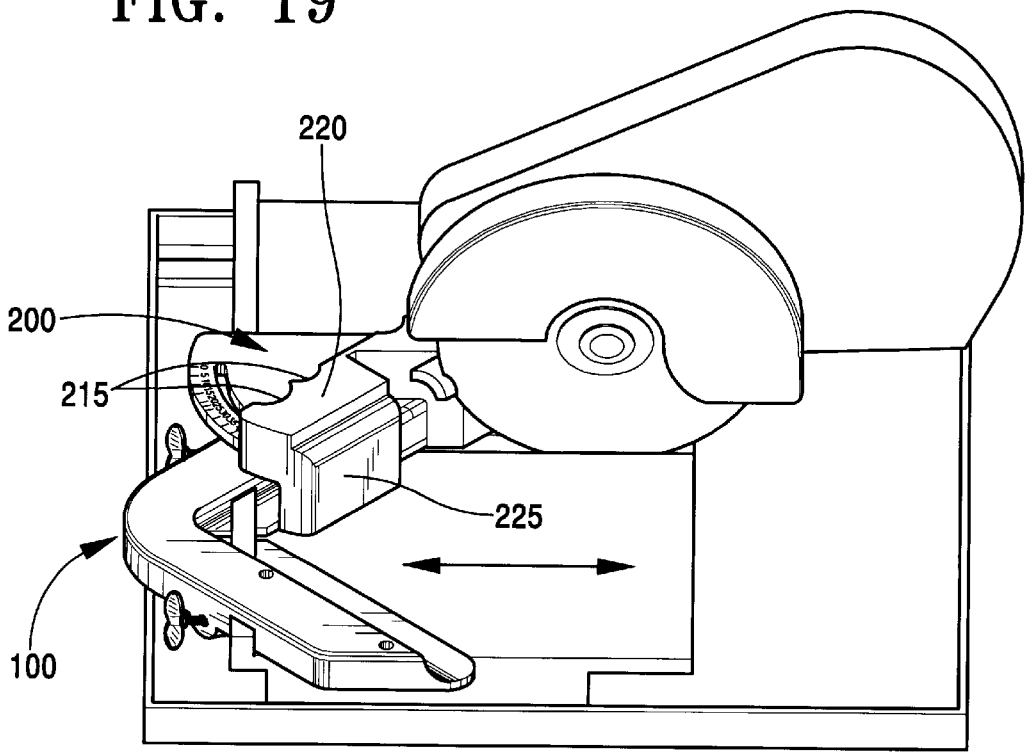
FIG. 19 is a perspective view of the invention, showing the embodiment of the invention with the pivoting plate, being used to cut a piece of curved tile on a tile saw.

Referring to FIG. 19, we see the embodiment of the Boomerangle, 100, with the pivoting plate, 200, being used with a tile saw. In this figure, the tile saw is shown cutting a piece of semi-circular curved tile.

Each of the elements described above, or two or more together, may also find a useful application in other types of methods differing from the type described above. While certain novel features of this invention have been shown and described and are pointed out in the annexed claims, it is not intended to be limited to the details above, because various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. A device comprising:

a. a planar piece of material having a top and bottom and being formed with two arms wherein the two arms are perpendicular such that there is a rectilinear opening between the arms and wherein the two arms each have a terminal end and a juncture at an end opposite of their terminal ends so that the two arms form a single, continuous piece of material;

b. a rectilinear slot in the bottom of said material wherein the rectilinear slot passes through each of the two arms and is defined, over at least part of its length, by three sides.

2. The device of claim one, further comprising:

a. a pivoting plate with a pivot pin which is inserted into the top of the planar piece of material wherein the pivoting plate has a curved front section.

3. In combination with a tile saw of the type having a reservoir for water, a sliding table with a fence for holding tile, and an arbor holding a blade where the blade is perpendicular to the fence, an improvement comprising:

a. a planar piece of material having a top and bottom and being formed with two arms wherein the two arms are perpendicular such that there is a rectilinear opening between the arms;

b. a slot in the bottom of said material having a rectilinear shape suitable for engaging the fence of said tile saw, such that the slot firmly engages said fence of said tile saw and holds the material in a fixed orientation.

4. The device of claim three, further comprising:

a. a pivoting plate with a pivot pin which is inserted into the top of the planar piece of material wherein the pivoting plate has a curved front section.

* * * * *